US008567091B2

(12) United States Patent
Jeong et al.

(10) Patent No.: US 8,567,091 B2
(45) Date of Patent: Oct. 29, 2013

(54) AUTOMATIC DRYER CONTROL BASED ON LOAD INFORMATION

(75) Inventors: Hae Deog Jeong, Changwon-shi (KR); In Haeng Cho, Changwon-shi (KR); Jae Suk Yang, Kyongsangnam-do (KR)

(73) Assignee: LG Electronics Inc, Seoul (KR)

( * ) Notice: Subject to any disclaimer, the term of this patent is extended or adjusted under 35 U.S.C. 154(b) by 2301 days.

(21) Appl. No.: 10/327,665

(22) Filed: Dec. 24, 2002

(65) Prior Publication Data

US 2004/0118008 A1 Jun. 24, 2004

(51) Int. Cl.
*F26B 11/00* (2006.01)

(52) U.S. Cl.
USPC ..... 34/606; 34/552

(58) Field of Classification Search
USPC ..... 34/476, 493, 535, 543, 547, 552, 553, 34/606, 595, 127, 129, 486, 587, 517, 34/609; 236/51; 68/5 C, 5 R, 18 R; 8/137, 8/159
See application file for complete search history.

(56) References Cited

U.S. PATENT DOCUMENTS

| | | | | |
|---|---|---|---|---|
| 3,540,241 | A | 11/1970 | Jacbobs | |
| 3,824,813 | A | 7/1974 | Davis | |
| 4,086,707 | A * | 5/1978 | Bochan | 34/554 |
| 4,485,566 | A * | 12/1984 | Vivares | 34/547 |
| 4,649,654 | A * | 3/1987 | Hikino et al. | 34/493 |
| 4,827,627 | A * | 5/1989 | Cardoso | 34/526 |
| 4,836,700 | A | 6/1989 | Jensen | |
| 4,891,892 | A * | 1/1990 | Narang | 34/86 |
| 5,228,212 | A * | 7/1993 | Turetta et al. | 34/493 |
| 5,444,996 | A | 8/1995 | Joslin et al. | |
| 5,905,648 | A | 5/1999 | Badami | |
| 2001/0015082 | A1 | 8/2001 | Minayoshi et al. | |

FOREIGN PATENT DOCUMENTS

| | | |
|---|---|---|
| AU | B-33121/95 | 4/1996 |
| CN | 1301893 A | 7/2001 |
| DE | 41 38 440 A1 | 5/1993 |
| DE | 198 02 650 A1 | 7/1999 |
| EP | 0067896 A1 | 12/1982 |
| FR | 2 635 539 | 2/1990 |

(Continued)

OTHER PUBLICATIONS

Notification of First Office Action, dated Jul. 1, 2005.

*Primary Examiner* — Steve M Gravini
(74) *Attorney, Agent, or Firm* — McKenna Long & Aldridge LLP

(57) ABSTRACT

A drying machine according to the present invention includes an interface unit connected to a separate washing machine with a data communication line for receiving load information from the washing machine, a rotatable drum containing a load of wet clothes which are previously washed by the washing machine, and an air supply system coupled to the drum for supplying dry air into the drum. The machine further includes a heater coupled to the air supply system for heating the dry air, and a dryer controller generating a control signal to the heater in accordance with a set of operation values which are determined based on the load information. A method of operating a drying machine according to the present invention includes the steps of receiving load information from a separate washing machine that performs wash/dehydration cycles on a load of clothes, determining a set of optimal operation values for operating a heater on the basis of the load information where the heater heats the dry air being supplied into a drum containing the load of wet clothes, and generating a control signal to the heater in accordance with the determined optional values.

9 Claims, 4 Drawing Sheets

(56) References Cited

FOREIGN PATENT DOCUMENTS

| | | |
|---|---|---|
| JP | 5293300 | 9/1993 |
| JP | 06-205900 | 7/1994 |
| JP | 07-323195 | 12/1995 |
| JP | 10-155099 | 6/1998 |

* cited by examiner

AUTOMATIC DRYER CONTROL BASED ON LOAD INFORMATION

BACKGROUND OF THE INVENTION

1. Field of the Invention

The present invention relates to a drying machine, and more particularly, to an automatic drying machine and a method of operating the drying machine for drying a load of wet fabrics according to a set of optimal operation values determined on the basis of load information including the load size and fabric blend that are previously determined by a separate washing machine.

2. Discussion of the Related Art

On most of the currently existing washing machines (washers), the amount of water that the machines use, the velocity-toque waveforms of the agitation, and/or the tub speeds (e.g., centrifugal extraction or spin-dry speed) for a wash or dehydration cycle are often determined by load information including the load size (e.g., load weight or mass) and/or fabric type of a load of clothes, which are usually selected by the user via a manual control. However, the manual selections of such load sizes and fabric types may not provide the optimal washing option for a given load of clothes because such manual controls often offers only a limited number of selections such as small, medium, and large for the load sizes and cotton, wool, and polyester for the fabric types or because the user may unintentionally select inaccurate load information. For example, if a small load size is selected by the user for a large load of clothes, the clothes will not be washed effectively. On the other hand, if a load size, which is larger than is actually needed for the optimal washing process for a given load of clothes, is selected by the user, the use of more water than is needed for the optimal washing process will result a wasteful use of water and energy during the wash or dehydration (or spin-dry) cycle.

In order to resolve the mentioned problem, several automatic calculations of the load size and/or fabric type of a given load of fabrics to be washed have been suggested as one of the possible ways of reducing any wasteful energy and water consumption and optimizing the washing performance of the washing machine by using the automatically calculated load information for determining agitation waveform, tub speed, and the optimal amount of water added to the washer for a washing cycle. For example, one of the well known ways of determining the load size of a load of clothes is to determine the moment of inertia of the load by operating the motor with a constant torque and measuring the time required for the motor to accelerate the clothes basket and the load of clothes from a first predetermined speed to a second predetermined speed. In general, it takes more time for the motor to accelerate the load of clothes, as the load size is greater and vice versa.

However, an ordinary washing machine that uses the load information, which is automatically calculated by a controller or manually inputted by the user as described above, in determining the optimal washing option does not have an interface unit for transmitting such load information to another laundry device (e.g., dryer). Therefore, when the user desires to operate a separate drying machine for drying a load of wet clothes which are already washed and dehydrated by the washing machine, he or she must manually input the load information or the automatic calculation of the load information must be done again for optimizing the drying performance of the drying machine and for reducing any wasteful energy consumption. Consequently, this may cause great inconvenience to the user or may add great complexity to the drying machine. For these reasons, it is desirable to provide a washing machine that includes an interface unit for being connected to a separate drying machine so that the load information automatically calculated by the washing machine (or manually selected by the user) before or during a washing cycle can be transmitted to the drying machine. In addition, it is also desirable to provide a drying machine that is connected to a separate washing machine and is able to determine the optimal drying option for a given load of wet clothes based on the load information that it receives from the washing machine without the necessity of adding a complex equipment in the drying machine that makes it more complicate and unnecessarily expensive.

SUMMARY OF THE INVENTION

Accordingly, the present invention is directed to a fabric drying machine and a method of operating the drying machine that substantially obviates one or more problems due to limitations and disadvantages of the related art.

An object of the present invention is to provide a drying machine that is connected to a separate washing machine and is able to determine the optimal drying option for a given load of wet clothes based on the load information that it receives from the washing machine without necessity of adding unnecessary complexity to the drying machine.

Another object of the present invention is to provide a method of operating a drying machine for drying a load of wet clothes by determining the optimal drying option based on the load information provided by a separate washing machine so that the drying performance is optimized and any wasteful energy consumption is greatly reduced.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a fabric drying machine includes an interface unit connected to a separate washing machine with a data communication line such as an RS232-C cable for receiving load information from the washing machine, a rotatable drum containing a load of wet clothes which are previously washed and/or dehydrated by the washing machine, and an air supply system coupled to the drum for supplying dry air into inside of the drum. The drying machine according to the present invention further includes a heater coupled to the air supply system for heating the dry air being supplied into the drum and a dryer controller operatively coupled to the heater for controlling the operation of the heater. The controller initially determines a first set of optimal operation values for operating the heater on the basis of the load information, and it generates a first control signal to the heater in accordance with; the determined operation values. The interface unit may further receive dehydration information from the washing machine. Then the controller should determine the set of optimal operation values further based on the dehydration information, which includes at least one of a rotational speed of a washer basket rotated during the previous dehydration and a total period of the previous dehydration.

The load information that the interface unit of the drying machine receives from the washing machine includes at least one of the load size value (e.g., load mass or weight) and fabric type of a load of wet clothes to be dried. These may be manually inputted by a washing machine operator or automatically determined by the washing machine prior to operating the drying machine. In addition, the set of operation values for operating the heater may include at least one of a temperature of the heated dry air being supplied into the drum and a total period of supplying power to the heater.

The drying machine according to the present invention described above may further include an electrical motor coupled to the drum for driving the motor. Then the dryer controller, which is additionally coupled to the motor, initially determines a second set of optimal operation values for operating the drum on the basis of the load information. Then it subsequently generates a second control signal to the motor in accordance with the determined second set of drum operation values, which include at least one of a rotational speed of the drum and a total period of supplying power to the motor.

Similarly, the drying machine of the present invention may further include another electrical motor coupled to the air supply system for driving the air supply system. Then the dryer controller, which is additionally coupled to the driving motor, determines another set of optimal operation values for operating the air supply system on the basis of the load information. Next, it generates another control signal to the driving motor in accordance with the determined set of air supply system operation values, where the operation values include at least one of an air supply rate of the air supply system and a total period of supplying power to the motor driving the air supply system.

In another aspect of the present invention, a method of operating a drying machine that dries a load of wet clothes, which are previously washed and dehydrated by a separated washing machine, includes the steps of receiving load information from the washing machine via an interface unit connected to the washing machine with a data communication line such as an RS232-C cable, determining a first set of optimal operation values for operating a heater on the basis of the load information where the heater heats the dry air being supplied by an air supply system into a drum containing the load of wet clothes, and generating a first control signal to the heater in accordance with the determined set of heater operation values. The load information that the interface unit receives from the washing machine includes at least one of a load size value and a fabric type, which may be manually inputted by a washing machine operator or automatically determined by the washing machine. In addition, the first set of operation values may include at least one of a temperature of the heated dry air being supplied into the drum and a total period of supplying power to the heater.

The method of operating the drying machine according to the present invention further includes the steps of determining a second set of operation values for operating the drum on the basis of the load information, and generating a second control signal to an electrical motor rotating the drum in accordance with the determined second set of operation values, which include at least of one of a rotational speed of the drum and a total period of supplying power to the drum-rotating motor.

Similarly, the method of operating the dying machine according to the present invention may further include the steps of determining another set of optimal operation values for operating the air supply system on the basis of the load information, and generating a control signal to an electrical motor driving the air supply system in accordance with the determined set of air supply system operation values, which include at least one of an air supply rate of the air supply system and a total period of supplying power to the motor that drives the air supply system.

Furthermore, the method described above may further include the step of receiving dehydration information from the washing machine. Then the first set of operation values for operating the heater should be determined further based on the dehydration information, which includes at least one of a rotational speed of a washer basket being rotated during the previous dehydration process and a total period of the previous dehydration.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1A:
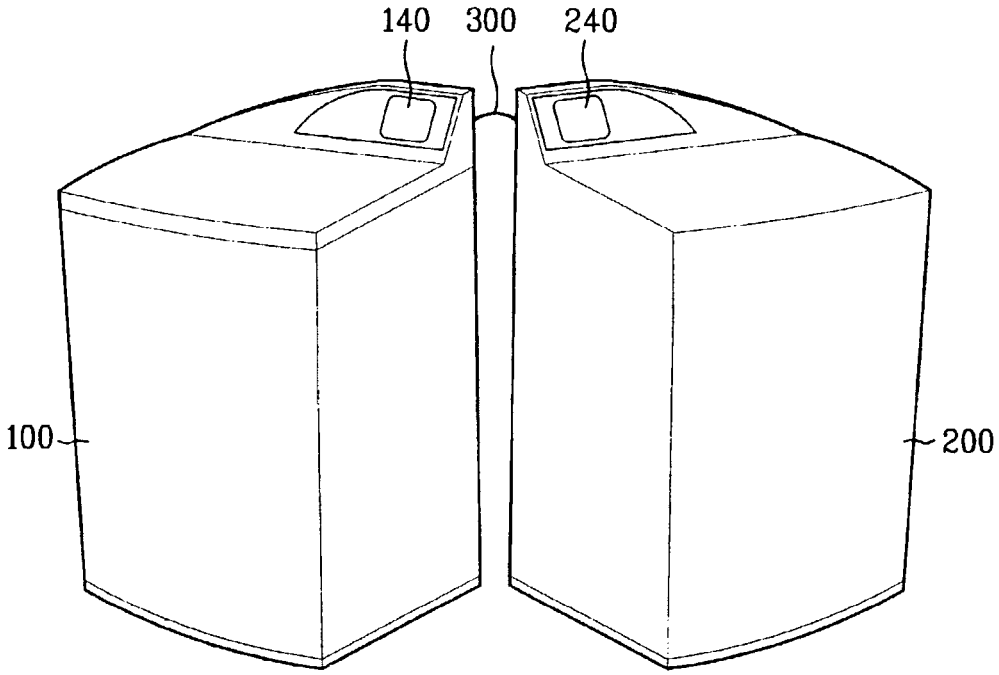
FIG. 1A illustrate a frontal view of a washing machine and a drying machine in accordance with one embodiment of the present invention.
Figure 1B:
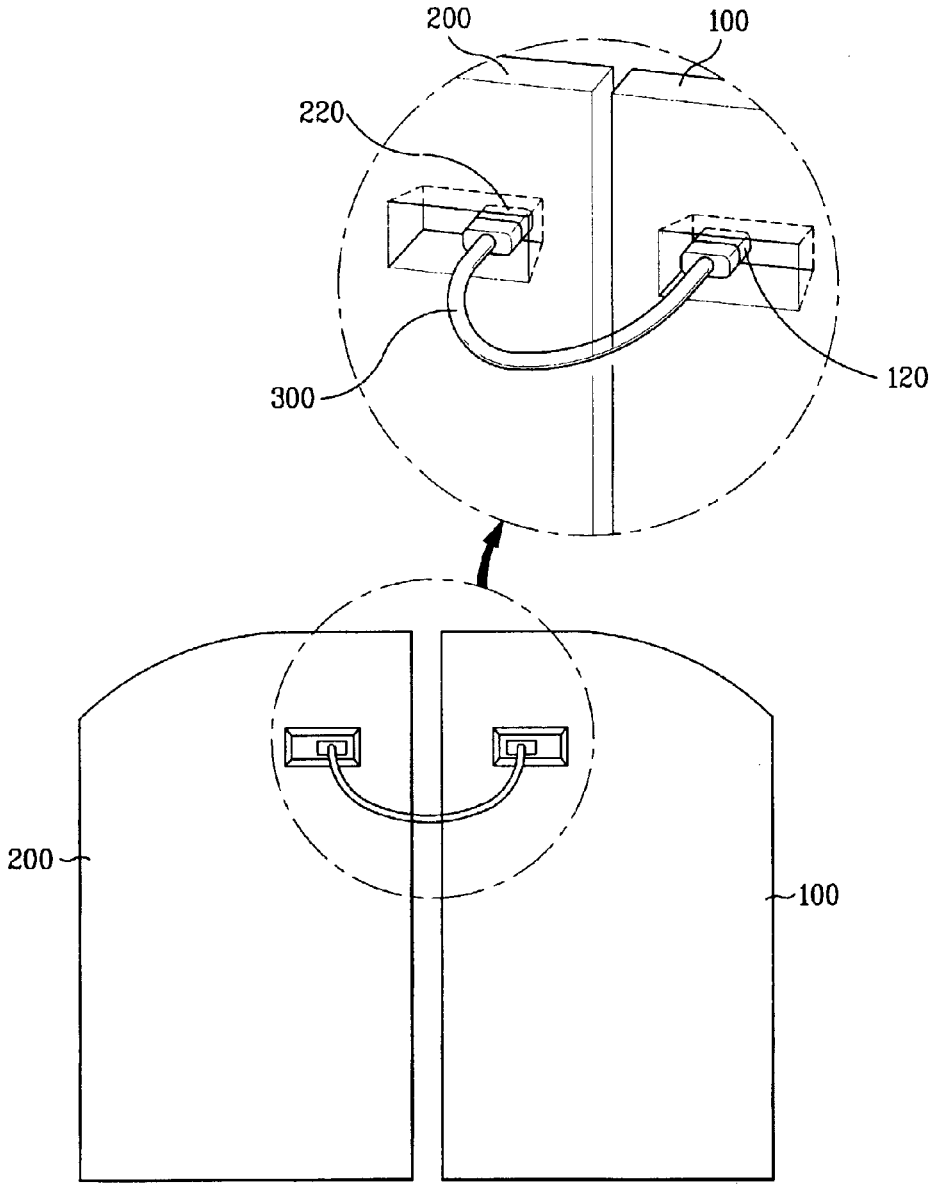
FIG. 1B illustrates a rear view of a washing machine and a drying machine in accordance with one embodiment of the present invention.

FIGS. 1A and 1B respectively illustrate the frontal and rear views of a washing machine 100 and a drying machine 200 in accordance with the present invention. Referring to FIG. 1A, the washing machine 100 includes a user interface unit 140 for receiving any command from a washer operator or for displaying any washer-related information, and similarly, the drying machine 200 also includes a user interface unit 240 for receiving any command from a dryer operator or for displaying any dryer-related information. As it can be seen from FIG. 1B, the drying machine 200 further includes a washer interface 220 for being connected to a dryer interface 120 of the washing machine 100 with a data communication line 300 through which the drying machine 200 can receive any information (e.g., load size and blend type information) for the optimal dryer operation from the washing machine 100. The data communication line 300 can be any one of a serial communication line such as an RS232-C cable, a universal serial bus (USB) connection line, a Bluetooth connection line, and a power line communication (PLC) line. The washer interface 220 is provided in the caved-in portion of the rear side of the drying machine 200 for preventing its connection to the communication line 300 from being wet during a wash cycle of the washing machine 100. Similarly, the dryer interface 120 is also provided in the caved-in portion of the rear side of the washing machine 100 for preventing its connection to the line 300 from being wet during the wash cycle.

Figure 2:
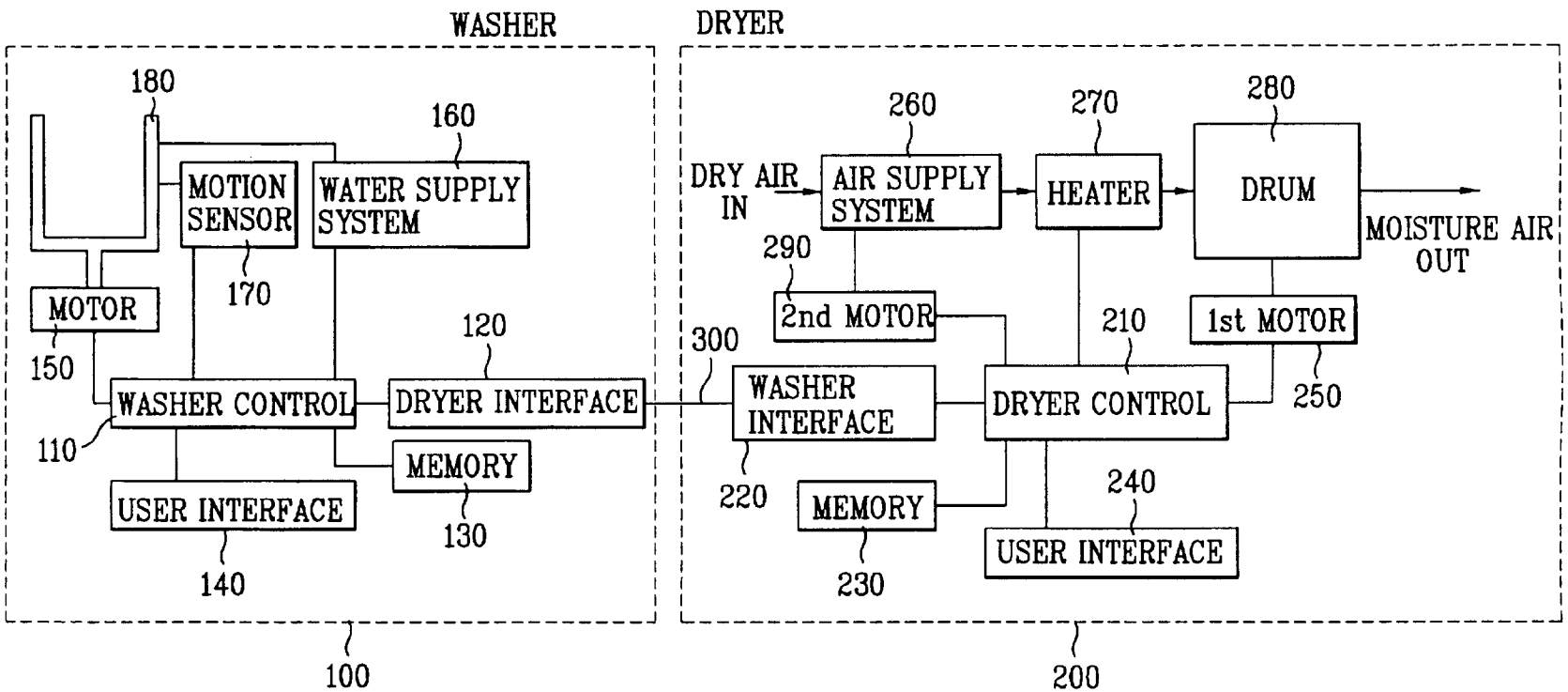
FIG. 2 illustrates a block diagram of a washing machine and a drying machine in accordance with one embodiment of the present invention.

FIG. 2. illustrates a block diagram of a washing machine 100 and a drying machine 200 in accordance with the present invention. The washing machine 100 shown in FIG. 2 includes a washer basket 180 containing a load of clothes to be washed, a motor 150 coupled to the basket 180 for rotating the basket 180 during a wash cycle and a dehydration cycle, a motion sensor 170 coupled to the basket 180 for measuring the horizontal displacement of the washer basket 180 that rotates during the dehydration cycle, and a water supply system 160 coupled to the basket 180 for supplying water required for washing and dehydration cycles. The washing machine 100 further includes a washer controller 110 operatively coupled to the motor 150, the water supply system 160 for performing the wash cycle, and an interface unit 120 through which the washer controller 110 transmits supplemental information to the drying machine 200.

Before a wash cycle is performed for a given load of clothes to be washed, the washer controller 110 initially determines load information including a load size (e.g., load mass or weight) and a fabric type of the load of clothes, which can be manually inputted by an operator or automatically determined. One way of automatically determining the load size is to determine the moment of inertia of the load of clothes by operating the motor 150 with a constant torque and measuring the time required for the motor to accelerate the washer basket 180 containing the load from a first predetermined speed to a second predetermined speed. Another way of determining the load size is to determine the moment of inertia of the load by initially accelerating the washer basket 180 up to a first predetermined speed and by measuring the time required for the basket 180 to decelerate to a second predetermined speed. In addition, one way of automatically determining the fabric type of the load of clothes by the washer controller 110 is to add water to the washer basket 180 containing the load in predetermined increments, to oscillate the basket 180 a given number of times, and to measure the required torque after each addition of water. The washer controller 110 then calculates the blend type of the load on the basis of the required torque and the load size value (whether automatically calculated or manually inputted). Once the load size and blend type values are determined, the controller 110 stores these values in the memory 130.

After the controller 110 determines the load information as described above, it performs a wash cycle and a dehydration cycle by generating control signals to the motor 150 and the water supply system 160 in accordance with a set of operation values, which may be determined on the basis of such load information.

The drying machine 200 shown in FIG. 2 includes a washer interface 220 connected to the dryer interface 120 of the washing machine 100 with a data communication line 300 for receiving supplemental information required for a drying cycle from the washing machine, a rotatable drum 280 containing a load of wet clothes that are washed and dehydrated by the washing machine 100, an air supply system 260 coupled to the drum 280 for supplying dry air into the drum 280. The drying machine 200 further includes a heater 270 coupled to the air supply system 260 for heating the dry air being supplied into the drum 280, a dryer controller 210 operatively coupled to the heater 270 for controlling the operation of the heater 270, a first electrical motor 250 coupled to the drum 280 for rotating the drum 280 in the drying cycle, and a second electrical motor 290 coupled to the air supply system 260 for driving the air supply system 260 in the drying cycle.

The supplemental information that the washer controller 210 receives from the washing machine 100 via the communication line 300 and the interface unit 220 includes load information and dehydration information. The load information includes at lest one of a load size (e.g., load mass or weight) and a fabric type of a load of wet clothes to be dried, and these values are manually inputted by a washing machine operator or automatically determined by the washer controller 110 prior to performing a wash cycle. On the other hand, the dehydration information includes at least one of a rotational speed of the washer basket 180 during a dehydration cycle and a total period of the dehydrating cycle, which are determined by the washer controller 110. In addition, the dehydration information may further include an instability level of the rotation of the washer basket 180 during the dehydration cycle, which is determined by the washer controller 110 by measuring the horizontal displacement of the washer basket 180 during the dehydration cycle due to uneven distribution of the load of clothes within the washer basket 180.

The dryer controller 210 shown in FIG. 2 includes an electronic processor (not illustrated), such as a computer, a microprocessor, or the like, that is able to receive the supplemental information from the washing machine 100 via the data communication line 300 and the washer interface unit 220, to process the received information to determine a set of optimal operation values for controlling the operations of the air supply system 260, the heater 270 and the drum 280 on the basis of the received supplemental information, and to respectively generate corresponding control signals to the systems in accordance with the determined set of operations values. The set of optimal operation values can be selected from a plurality of sets of predetermined operation values stored in a dryer memory 230 or can be calculated from a set of equations that are typically determined experimentally. Each of the plurality of sets of predetermined operation values provides a different drying cycle of operation of the drying machine 260.

For example, the dry controller 210 operatively connected to the heater 270 initially determines the optimal operation values for operating the heater 270 on the basis of the load information and/or the dehydration information. Then it subsequently generates a control signal to the heater 270 in accordance with the determined heater operation values, which include at least one of a desired temperature of the heated dry air being supplied into the drum 280 and a total period of supplying power to the heater 270. As mentioned above, these values can be selected from the predetermined heater operation values stored in the memory 230 or can be calculated from one or more predetermined equations.

In addition, the dryer controller 210, which is also connected to the first motor 250 for controlling the operation of the drum 280, further determines the optimal operation values for operating the drum 280 on the basis of the load information and/or the dehydration information. And it generates a control signal to the first motor 250 in accordance with the determined drum operation values, which include at least one of a rotational speed of the drum 280 and a total period of supplying power to the first motor 250. Similarly, these values can be selected from the predetermined drum operation values stored in the memory 230 or can be calculated from one or more predetermined equations.

Furthermore, the controller 210, which is further connected to the second motor 290 for controlling the operation of the air supply system 260, is able to further determine the optimal values for operating the air supply system 260 on the basis of the load information and/or dehydration information and is able to generate a control signal to the second motor 290 in accordance with the determined operating values, which include at least one of an air supply rate of the air supply system 260 and a total period of supplying power to the second motor 290. Similarly, these values can be selected from the predetermined air supply system operation values stored in the memory 230 or can be calculated from one or more predetermined equations.

Figure 3:
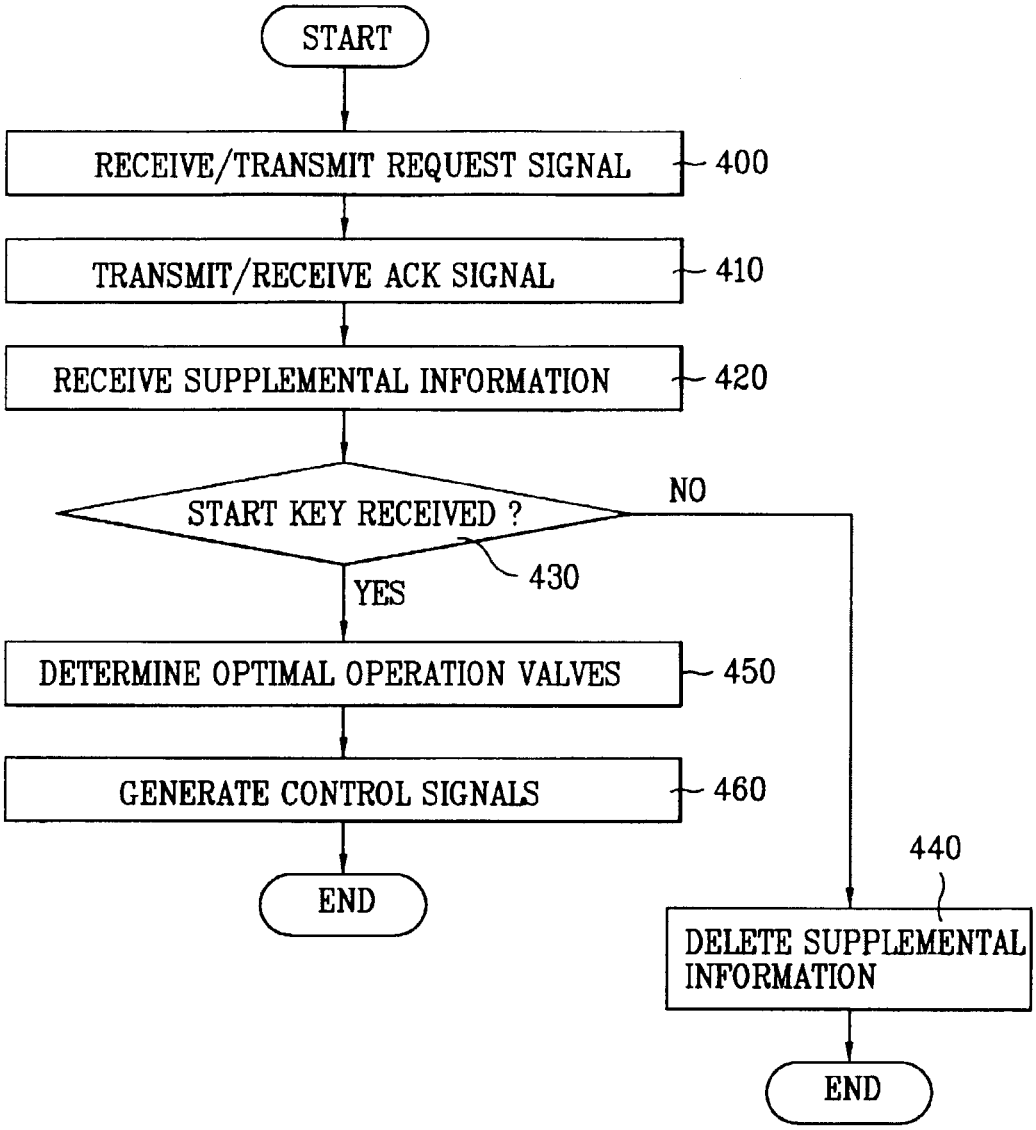
FIG. 3 is a flow chart illustrating a method of operating a drying machine in accordance with one embodiment of the present invention.

FIG. 3 is a flow chart illustrating a method of operating a drying machine according to one embodiment of the present invention. If an operator initially opens a washer door (not illustrated) or presses a prescribed key button provided on the user interface 140 of the washing machine 100 after the washing machine 100 performs a wash cycle, the dryer controller 210 receives a connection request signal (e.g., a ready signal) from the washer controller 110 via the data communication line 300, which is connected between the interface unit 120 and the interface unit 220 (S400). Then the dryer controller 210 transmits an acknowledgement (ACK) signal in response to the request signal (S410), indicating that the dry controller 210 is ready to receive any data. Alternatively, if the operator initially opens a dryer door (not illustrated) or presses a prescribed key button provided on the user interface 240 of the drying machine after the washing machine 100 performs a wash cycle, the dryer controller 210 transmits a connection request signal (e.g., a ready signal) to the washer controller 110 via the data communication line 300 (S400). Then the dryer controller 210 receives an ACK signal from the washer controller 110 in response to the request signal (S410). After connection between the washing machine 100 and the drying machine 200 is established in step S410, the washer controller 110 then transmits the supplemental information (e.g., load information and/or dehydration information), which is stored in the memory 130. Then the dryer controller 210 receives the supplemental information via the interface unit 220 connected to the washing machine 100 with the data communication line 300 and stores them in the dryer memory 230 (S420).

Next, the dryer controller 210 checks whether a start key has been inputted by the operator through the user interface 240 within a given period of time after the supplemental information is received (S430). If it determines that such key is inputted within the given period of time, it determines a set of optimal operation values for controlling the operations of the air supply system 260, the heater 270 and the drum 280 on the basis of the received supplemental information (S450). Otherwise, it deletes the supplemental information stored in the memory 230 (S440). The set of optimal operation values can be selected from a plurality of sets of predetermined operation values stored in the memory 230, each of which provides a different drying cycle of operation of the drying machine 200, or can be calculated from a set of experimentally determined equations.

In step S450, the dry controller 210 connected to the heater 270 determines the optimal heater operation values based on the stored supplemental information, where the operation values include at least one of a desired temperature of the heated dry air being supplied into the drum 280 and a total period of supplying power to the heater 270. In addition, the controller 210 further connected to the first motor 250 determines the optimal drum operation values on the basis of the stored supplemental information, where the drum operation values include at least one of at least one of a rotational speed of the drum 280 and a total period of supplying power to the first motor 250. Furthermore, the controller 210 further connected to the second motor 290 determines the optimal values for operating the air supply system 260 on the basis of the stored supplemental information, where the air supply system operation values include at least one of an air supply rate of the air supply system 260 and a total period of supplying power to the second motor 290.

After all the optimal operation values are determined in the step S450, the dyer controller 210 respectively generates control signals to the heater 270, the first motor 250 and the second motor 290 in accordance with the determined optimal operation values (S460). In other words, the dryer controller 210 generates a first control signal to the heater 270 in accordance with the determined heater operation values, a second control signal to the first motor 250 in accordance with the determined drum operation values, and generates a third control signal to the second motor 290 in accordance with the determined air supply system operation values.

Thus, a drying machine in accordance with the present invention initially receives the supplemental information that includes the load information and previous dehydration information of a load of wet clothes to be dried, and it determines a set of optimal operation values for controlling the operation of each part of the drying machine. Therefore, the drying machine is able to select the optimal drying cycle and reduce any wasteful energy consumption without any necessity of adding complexity to the drying machine.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A fabric drying machine comprising:

an interface unit connected to a separate washing machine with a data communication line for receiving load information from said washing machine;

a rotatable drum containing a load of wet clothes to be dried, said load of wet clothes being previously washed and dehydrated by said washing machine;

an air supply system coupled to said drum for supplying dry air into said drum;

a heater coupled to said air supply system for heating said dry air;

a dryer controller operatively coupled to said heater, said controller determining a first set of optimal operation values for operating said heater on the basis of said load information and generating a first control signal to said heater in accordance with said determined first set of operation values; and an electrical motor coupled to said drum for rotating said drum, wherein said controller is additionally coupled to said motor, said controller determining a second set of optimal operation values for operating said drum on the basis of said load information and generating a second control signal to said motor in accordance with said determined second set of operation values.

2. The drying machine of claim 1, wherein said load information includes at least one of a load size value and a fabric type which are manually inputted by a washing machine operator or automatically determined by said washing machine.

3. The drying machine of claim 1, wherein said first set of operation values include at least one of a temperature of said heated dry air being supplied into said drum and a total period of supplying power to said heater.

4. The drying machine of claim 1, wherein said second set of optimal operation values include at least one of a rotational speed of said drum and a total period of supplying power to said motor.

5. A fabric drying machine comprising:

an interface unit connected to a separate washing machine with a data communication line for receiving load information from said washing machine;

a rotatable drum containing a load of wet clothes to be dried, said load of wet clothes being previously washed and dehydrated by said washing machine;

an air supply system coupled to said drum for supplying dry air into said drum;

a heater coupled to said air supply system for heating said dry air;

a dryer controller operatively coupled to said heater, said controller determining a first set of optimal operation values for operating said heater on the basis of said load information and generating a first control signal to said heater in accordance with said determined first set of operation values; and an electrical motor coupled to said air supply system for driving said air supply system, wherein said controller is additionally coupled to said motor, said controller determining a second set of optimal operation values for operating said air supply system on the basis of said load information and generating a second control signal to said motor in accordance with said determined second set of operation values.

6. The drying machine of claim 5, wherein said second set of optimal operation values include at least one of an air supply rate of said air supply system and a total period of supplying power to said motor.

7. The drying machine of claim 1, wherein said data communication line is an RS232-C cable.

8. The drying machine of claim 1, wherein said interface unit further receives dehydration information from said washing machine, said first set of optimal operation values for operating said heater being determined by said controller further based upon said dehydration information.

9. The drying machine of claim 8, wherein said dehydration information includes at least one of a rotational speed of a washer basket being rotated during said previous dehydration and a total period of said previous dehydration.

* * * * *